US006401794B1

(12) United States Patent
Hamilton

(10) Patent No.: US 6,401,794 B1
(45) Date of Patent: Jun. 11, 2002

(54) GYMNASIUM CURTAIN SYSTEM

(76) Inventor: Roy Hamilton, 1460 Lakeshore Dr., Dorval, Quebec (CA), H9S 2E6

( * ) Notice: Subject to any disclaimer, the term of this patent is extended or adjusted under 35 U.S.C. 154(b) by 0 days.

(21) Appl. No.: 09/864,152

(22) Filed: May 25, 2001

(51) Int. Cl.[7] ..... A47H 1/00
(52) U.S. Cl. ..... 160/243; 160/121.1; 160/122
(58) Field of Search ..... 160/243, 122, 160/121.1, 120, 242, 244, 245, 268.1, 310, 41

(56) References Cited

U.S. PATENT DOCUMENTS

| | | | | | |
|---|---|---|---|---|---|
| 1,307,729 | A | * | 6/1919 | Dunlop | 160/121.1 |
| 3,521,693 | A | * | 7/1970 | Kuss | 160/243 |
| 3,537,504 | A | * | 11/1970 | Deane | 160/243 |
| 3,693,695 | A | * | 9/1972 | Deane | 160/243 |
| 3,900,063 | A | | 8/1975 | Roller | 160/310 |
| 4,436,137 | A | * | 3/1984 | Charles | 160/242 |
| 4,480,675 | A | * | 11/1984 | Berkemeier | 160/121.1 |
| 4,987,942 | A | * | 1/1991 | Eriksson | 160/243 |
| 5,195,594 | A | * | 3/1993 | Allen et al. | 160/243 X |
| 5,429,171 | A | | 7/1995 | Hamilton | 160/243 |
| 5,524,693 | A | * | 6/1996 | Hamilton | 160/243 |
| 6,131,641 | A | * | 10/2000 | Schroeder | 160/242 |
| 6,155,326 | A | * | 12/2000 | Imhoff et al. | 160/243 |

* cited by examiner

*Primary Examiner*—David M. Purol
(74) *Attorney, Agent, or Firm*—Wayne H. Yan; Max R. Wood

(57) ABSTRACT

A flexible partition suspended from a ceiling of a gymnasium or the like, includes a drive cylinder which extends the length of and intermediate of the curtain forming the partition. A cylinder is provided with an internal drive motor, and a reaction device is provided externally of the curtain such that the motor device when activated will drive the cylinder to wind-up the upper and lower portions of the curtain. In one embodiment, the upper portion is a single curtain panel and is attached to the periphery of the cylinder at an axial line. The lower portion includes two spaced curtain panels which are connected to the periphery of the cylinder at diametrically opposite lines thereon. In another embodiment both the upper portion and lower portion of the curtain include two curtain panels, so as to form a full-size double curtain. In such an arrangement, the flexible partition has a spaced-apart double panel configuration at least at its lower portion, to provide a better acoustic insulation.

11 Claims, 4 Drawing Sheets

GYMNASIUM CURTAIN SYSTEM

FIELD OF THE INVENTION

The present invention relates to a flexible partition, and more particularly to a curtain with an integrated wind-up device.

BACKGROUND OF THE INVENTION

It is well known to utilize flexible sheet type curtains, which are adapted to be rolled up, to divide or partition a large room such as a gymnasium. Such curtains might easily measure 40 feet in length by 20 feet in height. In most cases, an electrical motor drives a shaft on which the curtain is hung. Such an apparatus is described in U.S. Pat. No. 3,900,063, issued to Max F. Roller. As can be seen in the roller patent, the installation of such a curtain may be relatively involved since the motor and roll-up device must be mounted to the trusses or rafters supporting the ceiling. The torque required to wind-up the complete curtain is substantial, thereby increasing the height of the wind-up installation.

A further disadvantage of current flexible partition wall systems is that they do not lend themselves to providing proper barriers to dust or noise. In other words, there is no suitable device for sealing the vertical edges of the curtain to the walls forming the enclosure or room which is being divided by the curtain, when it is deployed. The Applicant has designed a flexible partition wall system to overcome the above mentioned disadvantages of current flexible partition wall systems, which is described in the Applicant's U.S. Pat. No. 5,429,171, issued on Jul. 4, 1995. The flexible partition described in that patent is suspended from a ceiling of a gymnasium or the like, and includes a drive cylinder which extends the length of and intermediate of the curtain forming the partition. The cylinder is provided with an internal drive motor, and a reaction device is provided externally of the curtain such that the motor device when activated will drive the cylinder to wind-up the upper and lower portions of the curtain. The upper and lower portions of the curtain are attached at diametrically opposed locations on the cylinder, and hook-and-loop type fastening strips are provided on the side edges of the curtain and on the side wall so as to seal the curtain against noise and dust.

The flexible partition wall system works well and has been welcomed by users. Nevertheless, the Applicant is seeking improvements thereof, particularly, a better acoustic insulation is desirable.

SUMMARY OF THE INVENTION

One object of the present invention is to provide an improved, relatively light, flexible partition for dividing large rooms, such as gymnasiums.

It is another object of the present invention to provide a flexible partition which is relatively simple to install.

It is a further object of the present invention to provide a flexible partition which provides better acoustic insulation to reduce the transmission of sound between the two divided portions of the room.

The construction of an apparatus in accordance with the present invention comprises a flexible partition for dividing a room, wherein the room includes a ceiling, a floor, and vertical side limiting means defining a vertical planar area. The flexible partition has dimensions to cover the vertical planar area and includes a flexible curtain with a top edge, a bottom edge touching the floor when the curtain is fully deployed, and side edges in contact with the respective vertical side limiting means. Means are provided for suspending the curtain from a structure supporting the ceiling. An elongated cylinder extends from one side edge of the curtain to the other and is connected to the curtain to divide the curtain into upper and lower portions. A motor means is located within the cylinder at least at one side edge of the curtain and a rotary drive means is driven by the motor means and connected to the cylinder. A torque reacting means is provided adjacent to the one side edge of the curtain and is associated with the motor means to resist rotation of the motor means with the cylinder in response to rotation of the rotary drive means. At least the lower portion of the curtain includes two flexible curtain panels connected to a periphery of the cylinder at first and second axial lines thereof. The two curtain panels are spaced apart from each other and extend in a parallel relationship when the curtain is fully deployed, for better acoustic insulation. The entire curtain is wound up on the cylinder when curtain roll-up is required.

More specifically, the cylinder includes a circular cross-section interrupted by four axial grooves. The grooves are equally and circumferentially spaced apart from one another. Bead means associated with the curtain selectively fit and lock into the individual grooves for connection of the cylinder and the curtain.

In a specific embodiment of the present invention, the upper portion of the curtain comprises one flexible curtain panel connected to the periphery of the cylinder at a third axial line thereon. The third axial line is equally and circumferentially spaced apart from the respective first and second axial connection lines of the two flexible curtain panels of the lower portion.

In another specific embodiment of the present invention, the upper portion of the curtain comprises two flexible curtain panels connected to the periphery of the cylinder at respective third and fourth axial connection lines thereon. Thus, the two curtain panels of the upper portion are also spaced apart from each other and extend in a parallel relationship in the fully deployed condition. Preferably, the third and fourth axial lines are circumferentially spaced 90° apart, and diametrically opposite to the respective first and second axial lines.

Alternatively, the two curtain panels of the upper portion and the two curtain panels of the lower portion are preferably integrated respectively to form two full-size curtain panels, according to a further embodiment of the present invention. The cylinder is flanked by the two full-size curtain panels. A flexible connection section interconnects the periphery of the cylinder and each of the full-size curtain panels.

In the embodiments having double panels of the upper portion, the suspending means is preferably adapted to adjust the vertical positions of the top edges of the curtain panels of the upper portion relative to each other to ensure that both the curtain panels of the upper portion properly extend and are properly wound up on the cylinder when the curtain is in a wind-up process.

The side edges of the curtain panels and the respective side limiting means are preferably each provided with elongated cooperating hook-and-loop type fastening strips in order to seal the side edges of the curtain panels to the respective side limiting means when the curtain is deployed.

In contrast to the existing single panel curtains, the double panel curtains will provide much better acoustic insulation to reduce the sound transmission between the two divided portions of the room. In a number of situations, such as sports activities in gymnasiums, the most significant noise source is the people, including athletes and spectators especially when the spectators are not elevated on high indoor bleachers and no loud speakers hang from the ceiling. Thus, a flexible partition curtain with a double panel lower portion will provide good acoustic insulation. However, in gymnasiums provided with high indoor bleachers and loud speakers hanging from the ceilings, a flexible partition curtain with double panels from the top to the bottom are necessary in order to provide effective acoustic insulation.

Other advantages and features of the present invention will be better understood with reference to the preferred embodiments of the invention described hereinafter.

BRIEF DESCRIPTION OF THE DRAWINGS

Having thus generally described the nature of the invention, reference will now be made to the accompanying drawings, showing by way of illustration, preferred embodiments thereof, in which.

DETAILED DESCRIPTION OF THE PREFERRED EMBODIMENTS

Figure 1:
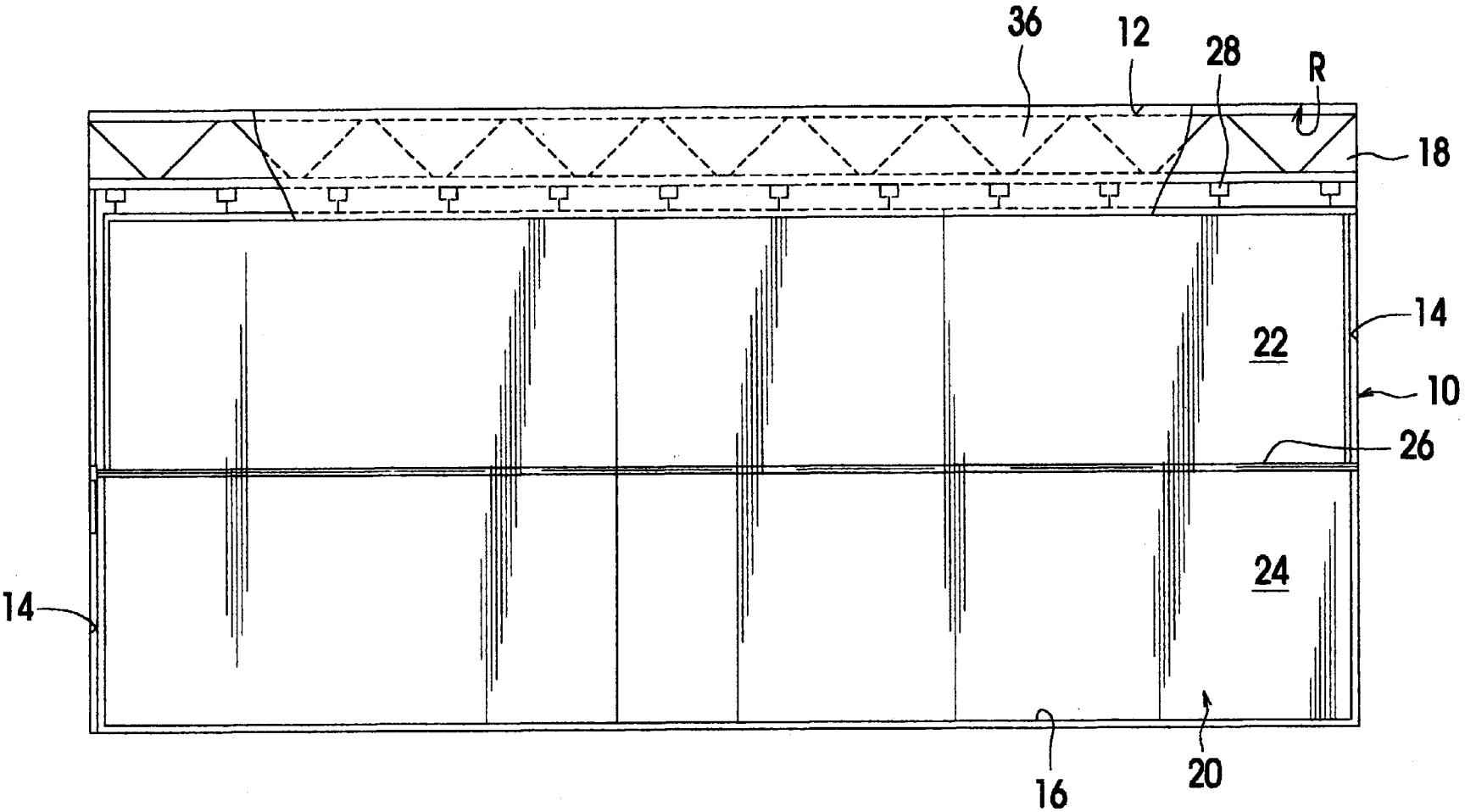
FIG. 1 is a front elevation of the fully deployed, flexible partition, according to one preferred embodiment of the present invention.
Figure 2:
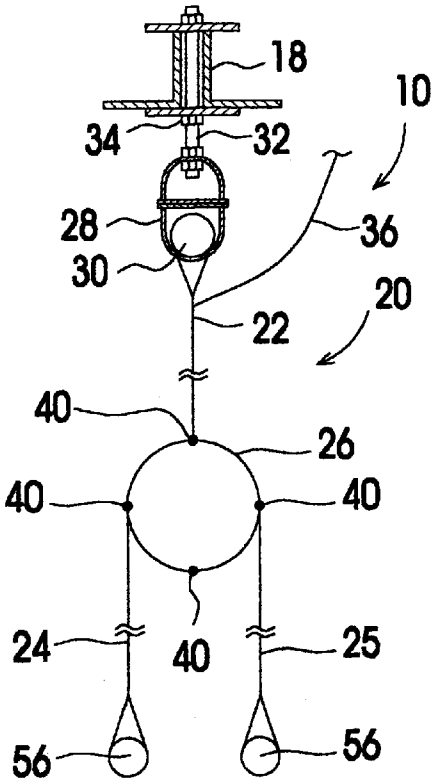
FIG. 2 is a fragmentary vertical cross-section of the flexible partition shown in FIG. 1, taken laterally.

With reference to FIGS. 1 and 2, a flexible partition generally indicated at numeral 10, is fully deployed in a room R. The room R might be a gymnasium or other large room such as an industrial factory or a convention hall. The room R includes a ceiling 12, a floor 16, and side walls 14, In the present embodiment, the partition 10 is shown as being hung from a truss grader 18 which extends from one wall 14 to the opposite lateral side wall 14 and which supports the ceiling 12. The flexible partition 10 includes a curtain 20 which in this embodiment, is made of an upper curtain panel 22 and two lower curtain panels 24. A cylinder 26 separates the upper curtain panel 22 from the lower curtain panels 24, as will be described further. The flexible curtain 20 may be made up of 18 oz. reinforced polyester in vinyl or reinforced nylon in urethane.

Figure 3:
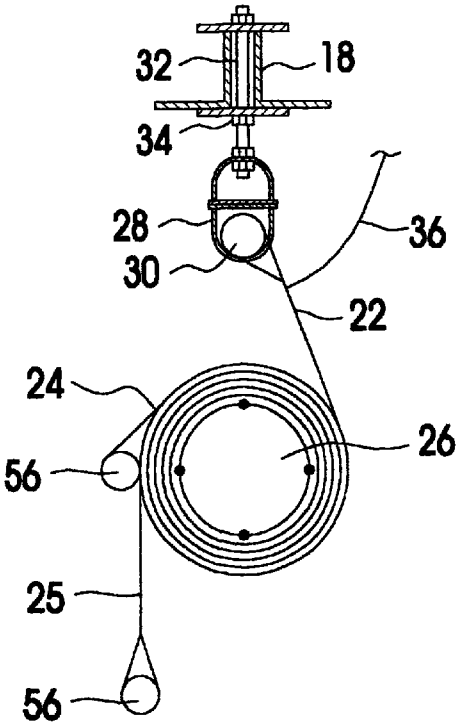
FIG. 3 is a vertical cross-section of the flexible partition shown in FIG. 1, taken laterally of the flexible fully wound-up partition.

Referring now to FIGS. 2 and 3, the upper edge of the upper curtain panel 22 is suspended from the truss grader 18 by means of a plurality of brackets 28 positioned in a spaced apart relationship along the length of the truss grader 18. Each bracket 28 retains a section of rod or tube 30 therein and has a bottom opening for permitting a piece of rope or strap connected to the upper edge of the upper curtain panel 22 to extend therethrough to be attached to the section of the rod or tube 30. The bracket 28 is firmly secured to the truss grader 18 by means of a plurality of bolts 32 and nuts 34. The bracket 28 is assembled with separate upper and lower portions so that the bolts 32 and nuts 34 can be assembled to the upper portion before the bracket 28 is assembled.

A valence 36 may be suspended from the ceiling 12 and connected to the upper edge of the upper curtain panel 22 of the curtain 20, as shown in FIGS. 1, 2, and 3. The valence 36 may be provided on either side of the partition for better acoustic insulation.

Figure 4:
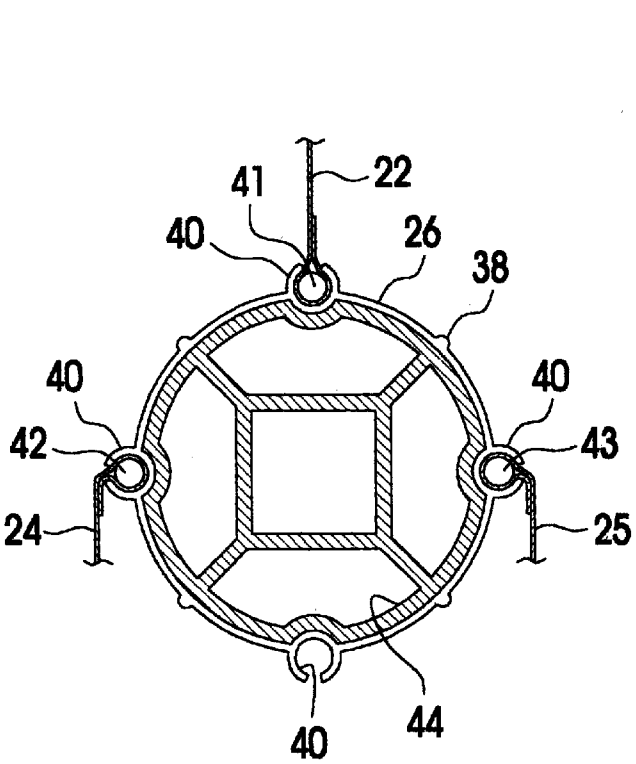
FIG. 4 is an enlarged fragmentary vertical cross-section, taken laterally of the flexible partition in FIG. 1, showing details of an elongated cylinder of the flexible partition.

The elongated wind-up cylinder 26 as more clearly shown in FIG. 4 may be a thin walled aluminum extrusion including longitudinally extending ribs 38 and four axial grooves 40 which are equally and circumferentially spaced apart from one another and adapted to selectively receive the beads 41, 42 and 43 of the upper curtain panel 22 and lower curtain panels 24 and 25, respectively. The configuration of the grooves 40 and the beads allows the beads 41, 42 and 43 to be selectively locked into three of the four grooves 40. In this embodiment, the beads 42 and 43 of the upper edges of the lower curtain panels 24 and 25 lock into the diametrically opposed grooves 40 and the bead 41 of the lower edge of the upper curtain 22 locks into one groove 40 positioned between the two diametrically opposed grooves 40, in which beads 42 and 43 lock.

Figure 5:
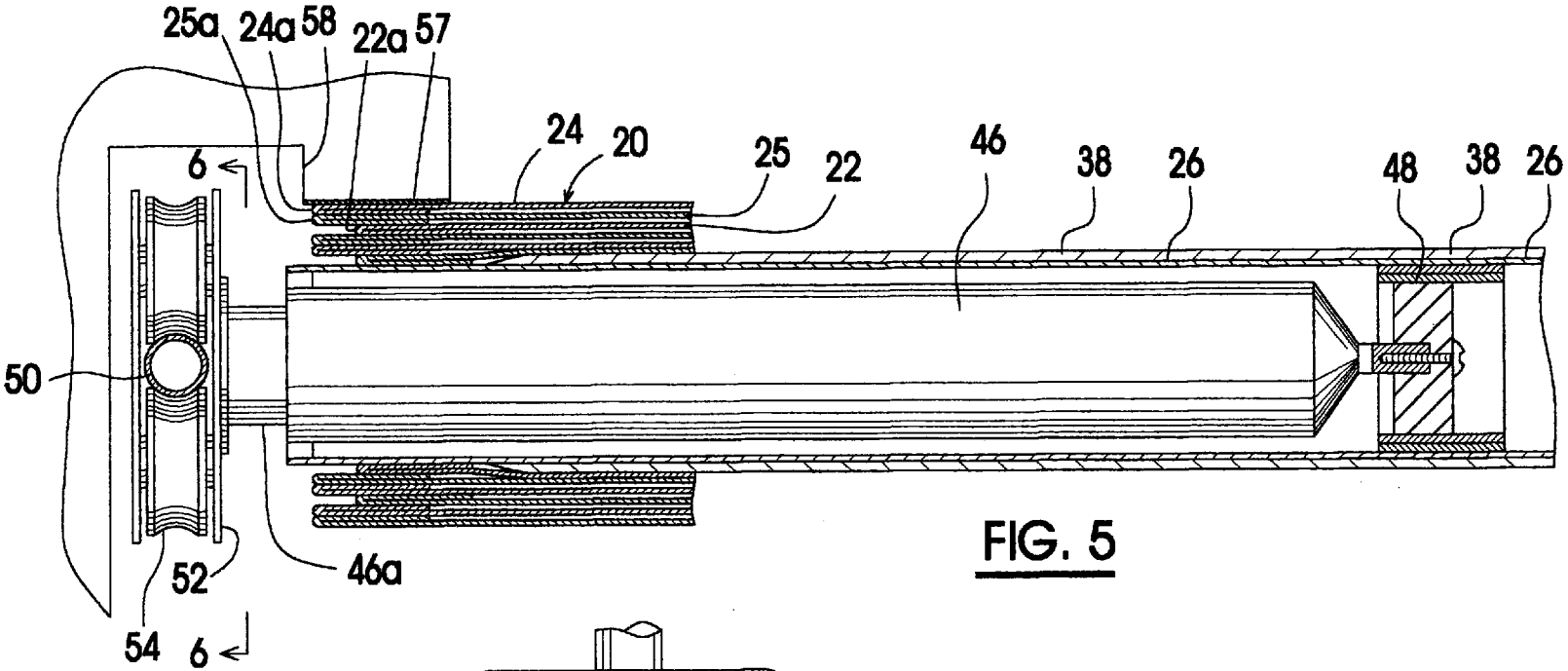
FIG. 5 is an enlarged fragmentary longitudinal cross-section of the details of the flexible partition shown in FIG. 1.
Figure 6:
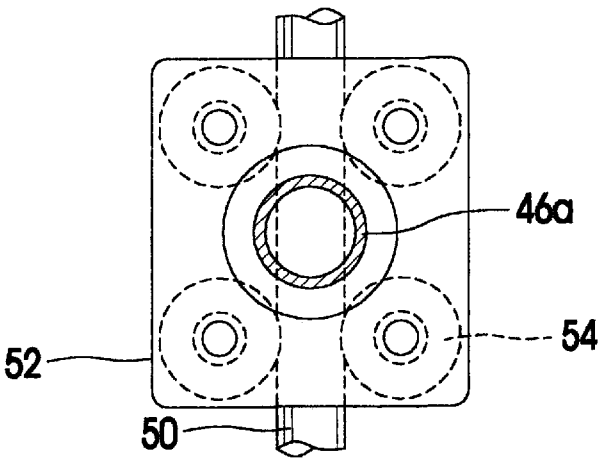
FIG. 6 is a vertical cross-section taken along line 6—6 of FIG. 5.

As can be seen in FIG. 5, the ends of the ribs 38 are tapered and cut away near the ends of the cylinder 26, in order to accommodate the hems 22*a*, 24*a*, and 25*a* and the fastening strip 57 at the edges of the curtain 20.

The cylinder 26 may be supplied in 20-foot sections, and the sections are connected end-to-end by inserts 44 having a slightly smaller diameter than the cylinder 26. The insert 44 is shown in FIG. 4.

A motor 46 is provided within the hollow portion of the cylinder 26 at least at one end of the cylinder and includes a rotary drive connection 48 as shown in FIG. 5. The other end of the motor is connected by means of an extension 46a to a carriage 52 which in turn mounts four idler wheels 54. The idler wheels 54 are adapted to surround a suspended tube 50. When the motor 46 is driven to rotate the cylinder 26 by means of the rotary drive connection 48, the reaction provided by the carriage 52 on the suspended tube 50 is to resist the torque, thereby preventing the rotation of the motor 46. It is contemplated that other torque resisting devices could be used including a fixed vertical guide member, a folding torque arm, fixed guide wires, or a retractable cable.

It is also contemplated that in the case of heavier curtains, two motors 46 would be required, one at each edge of the curtain 20.

As shown in FIG. 2, a weight 56 may also be provided at the lower edge of the lower curtain panels 24 and 25 such that the curtain 20 can be properly hung in the fully deployed condition, to form a lower portion having double panels spaced apart from each other and extending in a parallel relationship for better acoustic insulation.

In operation, as shown in FIGS. 3 and 5, when it is required to wind-up the curtain 20, the motor 46 is activated to rotate the rotary drive connection 48 and thus rotate the cylinder 26. The upper curtain panel 22 and the lower curtain panels 24, 25 of the curtain 20 will simultaneously be rolled up on the cylinder 26 as the cylinder 26 climbs on the upper curtain panel 22.

As shown in FIG. 5, for better acoustic insulation between the two divided room portions it is advantageous to provide strips of hook-and-loop fastening strips 57 on the edges of the curtain 20 and on an alcove 58 formed on the walls 14, which is well described in the Applicant's U.S. Pat. No. 5,429,171 and is incorporated herewith by reference.

Figure 7:
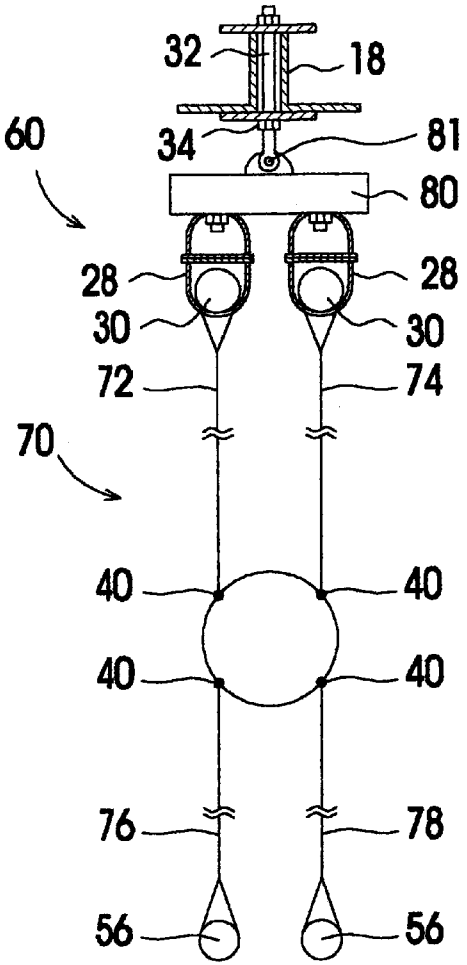
FIG. 7 is a fragmentary vertical cross-section taken laterally of the fully deployed, flexible partition according another preferred embodiment of the present invention.

In FIG. 7 a flexible partition 60 according to another preferred embodiment of the present invention includes a curtain 70. The curtain 70 has two flexible upper curtain panels 72 and 74 and two flexible lower curtain panels 76 and 78. The partition 60 is hung from two groups of brackets 28 (only one of each group is shown). Brackets 28 in each group are positioned in a spaced apart relationship along the length of the truss grader 18, each bracket 28 suspending the upper edge of one of the upper curtain panels 72 and 74 by means of the section of rod or tube 30 with the attached rope or strap, similar to those of the partition 10 as shown in FIG. 2.

In contrast to the assembly shown in FIG. 2, in which each bracket 28 is firmly secured to the ceiling support structure, a plurality of bridge members 80 are provided, positioned in a spaced apart relationship along the length of the ceiling support structure. Each bridge member 80 is secured to the ceiling support structure and is pivotable about a pin 81 which is secured to the bottom end of the bolt 32 and is parallel to the length of the ceiling support structure. A pair of the brackets 28 in the respective groups are suspended from the bridge member 80 at the opposed ends thereof.

The lower curtain panels 76 and 78 are secured to the periphery of the cylinder 26 at the respective two adjacent axial grooves 40 in a manner similar to that shown in FIG. 2 and will not be further described. The lower edges of the upper curtain panels 72 and 74 are secured to the periphery of the cylinder 26 at the other two of the grooves 40, respectively. The upper curtain panels 72, 74 and the lower curtain panels 76, 78 are joined with the cylinder 26 to form the full-size double panel curtain 70. The bottom edges of the lower curtain panels 76, 78 touch the floor when the full-size double curtain 70 is fully deployed under its own gravity and the weight 56 attached thereto.

When curtain wind-up is required, the upper curtain panels 72, 74 and the lower curtain panels 76, 78 will simultaneously be rolled up on the cylinder 26 as the cylinder 26 climbs on the upper curtain panels 72 and 74, in a manner similar to that shown in FIG. 3.

Figure 9:
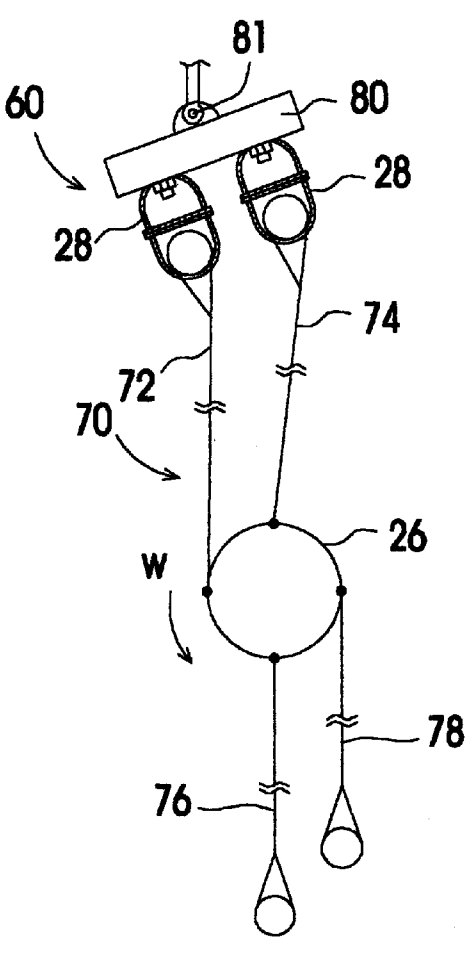
FIG. 9 is a fragmentary vertical cross-section of the flexible partition in FIG. 7 showing the partition being wound up.

During a first rotation of the cylinder, of about 45° in a direction indicated by arrow W, as shown in FIG. 9, when the flexible partition 60 begins to be wound up, the upper curtain panel 72 and lower curtain panel 78 are wound up on the cylinder 26 about ⅛ of the periphery thereof while the upper curtain panel 74 and the lower curtain panel 76 are not yet wound up on the cylinder 26. This will shift the weight of the curtain 70 which is evenly supported by the two groups of brackets 28 when the curtain 70 is fully deployed, to the left hand group of brackets 28, thereby pivoting the bridge members 80 to adjust the vertical positions of the two upper edges of the upper curtain panels 72 and 74 relative to each other until the upper curtain panel 74 properly extends to transfer an appropriate proportion of the weight of the curtain 70 back to the right hand group of brackets 28.

It is contemplated that the pivotable bridging feature could be implemented by other suspending devices having automatic height adjustment features. Without such a height adjustment feature, one upper curtain panel (the panel 74 in this case) would sag and not be properly wound up on the cylinder 26, thereby creating wrinkles thereon and presenting an unacceptable appearance when the curtain is fully deployed the next time.

The cylinder 26 advantageously includes four equally and circumferentially spaced axial grooves 40 so that a single design of the cylinder 26 can be used for both embodiments shown in FIG. 2 and FIG. 7.

Figure 8:
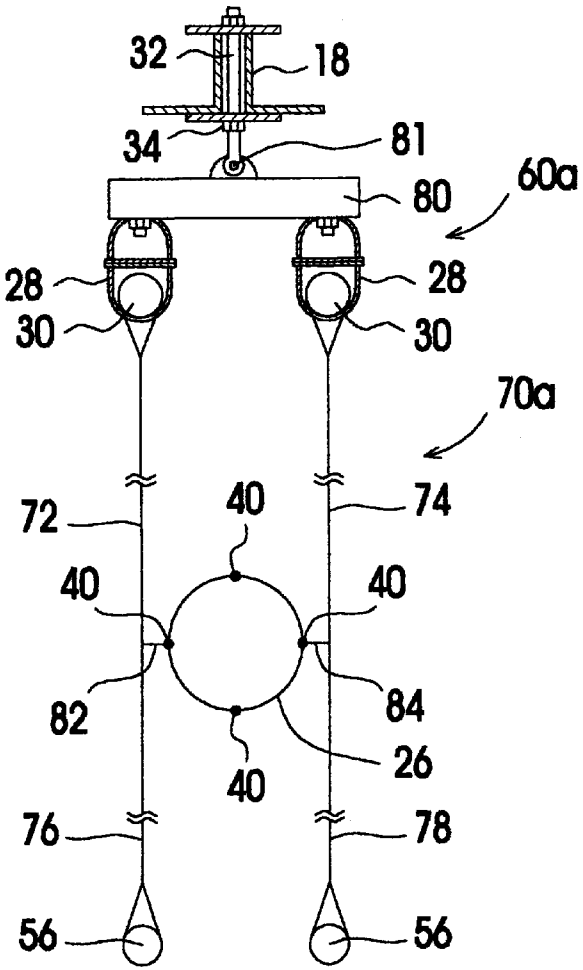
FIG. 8 is a fragmentary vertical cross-section taken laterally of the fully deployed, flexible partition according to a further preferred embodiment of the present invention.

In FIG. 8 a flexible partition **60*a* according to a further preferred embodiment of the present invention, includes a flexible curtain 70*a* which is similar to the embodiment illustrated in FIG. 7. The difference between the flexible partition 60*a* and the flexible partition 60 lies in that the two groups of brackets 28 are spaced apart a distance greater than the diameter of the cylinder 26, and the upper curtain panels 72, 74 and the lower curtain panels 76, 78 are not directly secured to the periphery of the cylinder 26. Instead, the individual upper curtain panels 72, 74 are integrated with the individual lower curtain panels 76, 78 to form two respective full-size panels. A pair of flexible connection sections 82 and 84, which are preferably made of the same material as the curtain panels, interconnect the periphery of the cylinder 26 at a pair of diametrically opposite axial grooves 40 thereof and the respective full-size curtain panels, each at the integrated lower edge of the upper curtain panel 72 or 74 and the upper edge of the lower curtain panel 76 or 78**.

In such an arrangement, the two full-size curtain panels are spaced apart a distance greater than the diameter of the cylinder such that a standard cylinder 26 can be used with a flexible partition having double full-size curtain panels which are spaced apart a selected distance from each other as desired.

The connecting sections 82 and 84 will compensate for the difference in length between the upper curtain panels 72 and 74 when the curtain 70a is wound up on the cylinder 26, thereby reducing the pivoting angle of the bridge member 80 when the bridge member 80 is balanced.

It is to be understood that the invention is not limited to the illustrations described and shown herein, which are deemed to be merely illustrative of the best modes of implementation of the invention, and which are susceptible to modification of form, size, arrangement of parts, as well as details of configuration. The invention rather is intended to encompass all such modifications which are within its spirit and scope as defined by the claims.

I claim:

1. A flexible partition for dividing a room, wherein the room includes a ceiling, a floor, and vertical side limiting means, defining a vertical planar area, comprising:

a flexible curtain having dimensions to cover the vertical planar area and including a top edge, a bottom edge touching the floor when the curtain is fully deployed, and side edges in contact with the respective vertical side limiting means;

means for suspending the curtain from a structure supporting the ceiling;

an elongated cylinder extending from one side edge of the curtain to the other, connected to the curtain and dividing the curtain into upper and lower portions;

motor means located within the cylinder at least at one side edge of the curtain;

rotary drive means driven by the motor means and connected to the cylinder;

torque reacting means provided adjacent to the one side edge of the curtain and associated with the motor means to resist rotation of the motor means with the cylinder in response to rotation of the rotary drive means; and at least the lower portion of the curtain including two flexible curtain panels connected to a periphery of the cylinder at first and second axial lines thereon, the two curtain panels being spaced apart from each other and extending in a parallel relationship in the fully deployed condition for a better acoustic insulation, the entire curtain being wound up on the cylinder when it is required to roll up the curtain.

2. A flexible partition as claimed in claim 1 wherein the upper portion of the curtain comprises one flexible curtain panel connected to the periphery of the cylinder at a third axial line thereon, the third axial line being equally and circumferentially spaced apart from the respective first and second axial connection lines of the two flexible curtain panels of the lower portion.

3. A flexible partition as claimed in claim 1 wherein the upper portion of the curtain comprises two flexible curtain panels connected to the periphery of the cylinder, the two curtain panels of the upper portion being spaced apart from each other and extending in a parallel relationship in the fully deployed condition.

4. A flexible partition as claimed in claim 3 wherein the two panels of the upper portion are connected to the periphery of the cylinder at respective third and fourth axial lines thereon, the third and fourth axial lines being circumferentially spaced 90° apart, and diametrically opposite to the respective first and second axial lines.

5. A flexible partition as claimed in claim 3 wherein the two curtain panels of the upper portion and the two curtain panels of the lower portion are integrated respectively to form two full-size curtain panels, the cylinder extending between the two full-size curtain panels, a top edge of each full-size curtain panel being secured by the suspending means and a bottom edge of each full-size curtain panel touching the floor when the curtain is fully deployed.

6. A flexible partition as claimed in claim 5 wherein the two full-size curtain panels are spaced apart a distance greater than a diameter of the cylinder, a flexible connection section interconnecting the periphery of the cylinder and each of the full-size curtain panels.

7. A flexible partition as claimed in claim 1 wherein the cylinder comprises a circular cross-section interrupted by four axial grooves, the grooves being equally and circumferentially spaced apart from one another, and bead means associated with the curtain selectively fitting and locking into the individual grooves for connection of the cylinder and the curtain.

8. A flexible partition as claimed in claim 2 wherein the upper portion comprises a bead located at a lower edge of the one curtain panel and wherein the lower portion comprises one bead located at an upper edge of each of the two curtain panels, the beads selectively fitting and locking into respective three of four axial grooves which interrupt a circular cross-section of the cylinder and are equally and circumferentially spaced apart from one another.

9. A flexible partition as claimed in claim 4 wherein the curtain comprises four beads, a first and a second being connected to lower edges of the respective curtain panels of the upper portion, and a third and a fourth being connected to upper edges of the respective curtain panels of the lower portion, the beads fitting and locking into four respective axial grooves which interrupt a circular cross-section of the cylinder and are equally and circumferentially spaced apart from one another.

10. A flexible partition as claimed in claim 3 wherein the suspending means is adapted to adjust a vertical position of a top edge of one curtain panel of the upper portion relative to a vertical position of a top edge of the other curtain panel of the upper portion to ensure that both the curtain panels of the upper portion properly extend and are properly wound up on the cylinder when the curtain is in a wind-up process.

11. A flexible partition as claimed in claim 10 wherein the suspending means comprises a plurality of bridge members positioned in a spaced apart relationship along a length of the ceiling support structure, each bridge member being secured at a middle between two opposed ends thereof, to the ceiling support structure, each bridge member being pivotable about an axis parallel to the length of the ceiling support structure, the respective top edges of the curtain panels of the upper portion being suspended from the opposed ends of the bridge members such that the bridge members pivot at an angle, thereby adjusting the vertical positions of the upper edges of the two full-size curtains when the curtain is wound up.

* * * * *